United States Patent [19]

Fraser

[11] 4,082,061

[45] Apr. 4, 1978

[54] MULTI-COLOR DEVELOPMENT SYSTEM

[75] Inventor: Lawrence J. Fraser, Rochester, N.Y.

[73] Assignee: Xerox Corporation, Stamford, Conn.

[21] Appl. No.: 777,377

[22] Filed: Mar. 14, 1977

[51] Int. Cl.[2] ..... G03G 15/09

[52] U.S. Cl. ..... 118/645; 96/1.2

[58] Field of Search ..... 118/645, 655, 654, 658, 118/657; 96/1.2; 101/DIG. 3

[56] References Cited

U.S. PATENT DOCUMENTS

| | | | |
|---|---|---|---|
| 3,367,306 | 2/1968 | Lawes et al. | 118/645 X |
| 3,550,556 | 12/1970 | Chawda | 118/654 |
| 3,678,896 | 7/1972 | Hewitt | 118/655 X |
| 3,685,485 | 8/1972 | Kutswada et al. | 118/654 |
| 3,793,986 | 2/1974 | Latone | 118/657 X |
| 3,809,557 | 5/1974 | Pressman | 96/1.2 |
| 3,906,897 | 9/1975 | Davidson | 118/645 |
| 3,910,231 | 10/1975 | Inoue et al. | 118/645 |

*Primary Examiner*—Mervin Stein
*Assistant Examiner*—Andrew M. Falik
*Attorney, Agent, or Firm*—J. J. Ralabate; C. A. Green; H. Fleischer

[57] ABSTRACT

An apparatus arranged to develop a latent image recorded on a member with particles stored in the chamber of the housing. A plurality of differently colored particles are housed remotely from the chamber. Particles of a selected color are advanced to the chamber so as to be deposited on the latent image.

The foregoing abstract is neither intended to define the invention disclosed in the specification, nor is it intended to be limiting as to the scope of the invention in any way.

10 Claims, 5 Drawing Figures

MULTI-COLOR DEVELOPMENT SYSTEM

BACKGROUND OF THE INVENTION

This invention relates to an electrostatographic printing machine, and more particularly concerns an improved development system for use therein.

An electrostatographic printing process forms an electrostatic latent image and reproduces the image in viewable form on a copy sheet. The field of electrostatography includes electrophotography and electrography. Electrophotography employs a photosensitive medium to form, with the aid of electromagnetic radiation, the electrostatic latent image. Electrography utilizes an insulating medium to form, without the aid of electromagnetic radiation the electrostatic latent image. In both of the foregoing processes, the latent image is rendered viewable by the process of development, i.e. depositing particles thereon. Frequently, the particles are transferred from the latent image to a copy sheet, or, in some processes, the recording sheet on which the latent image is produced, may serve also as the copy sheet after the particles have been deposited thereon. In either of the foregoing cases, the resultant toner powder image deposited on the sheet is permanently affixed applying heat and/or pressure thereto. Hereinafter, an electrophotographic printing machine will be described as an illustrative embodiment of these processes.

In electrophotographic printing, the photoconductive member is charged to sensitize its surface. The charged photoconductive member is exposed to a light image of the original document being reproduced. Exposure of the sensitized photoconductive surface discharges the charge selectively in the irradiated areas. This creates an electrostatic latent image on the photoconductive surface corresponding to the original document being reproduced. Development of the electrostatic latent image recorded on the photoconductive surface isachieved by bringing developer material into contact therewith. Typical developer material comprises dyed or colored heat settable plastic powders, known in the art as toner particles, which are mixed with coarser carrier granules, such as ferro-magnetic granules. The toner particles and carrier granules are selected such that the toner particles require the appropriate charge relative to the electrostatic latent image recorded on the photoconductive surface. Thus, when the developer material is brought into contact with the latent image recorded on the photoconductive surface, the greater attractive force thereof causes the toner particles to transfer from the carrier granules and adhere to the electrostatic latent image. This concept was originally disclosed by Carlson in U.S. Pat. No. 2,297,691 and is further amplified and described by many related patents in the art.

With the advent of multi-color electrophotographic printing, it became highly desirably to reproduce color originals as color copies, or even black and white originals as color copies. Heretofore, the process of color electrophotographic printing required the utilization of filters to form successive single color light images from the colored original document. These single color light images record successive single color electrostatic latent images on the photoconductive surface. Each single color electrostatic latent image is developed with toner particles of a color complementary to the color of the filtered light image. These toner powder images, each of a different color, are transferred to the copy sheet in superimposed registration with one another. Thereafter, the multi-layer toner powder image is permanently affixed to the copy sheet. This produces a multi-color copy from a colored original document. The foregoing is fully described in U.S. Pat. No. 3,854,449 issued to Davidson in 1974.

Recently, it has been highly desirable to create a copy containing information in two or more colors. This may be achieved in high speed electrophotographic printing machines by masking selected portions of the original document or utilizing two or more original documents and reproducing the information contained therein on a common copy sheet in different colors. Different colors in the electrophotographic printing machine may be achieved by changing the color of the developer material employed in the development system. Thus, a black and white electrophotographic printing machine may be converted to a color printing machine simply by changing the color of the developer material contained within the development system. This requires cleaning the chamber storing the developer material so that no residual developer material remains therein prior to the introduction of the differently colored developer material. This is ncessary to prevent the contamination of the new charge of developer material by the residual developer material from the prior charge. Hence, it would be highly desirable to utilize a development apparatus containing a plurality of differently colored developer materials stored therein for subsequent application to the latent image automatically.

Accordingly, it is a primary object of the present invention to improve the multi-color capability of the development apparatus of an electrophotographic printing machine.

SUMMARY OF THE INVENTION

Briefly stated, and in accordance with the present invention, there is provided an apparatus for developing a latent image arranged to be recorded on a member with particles.

Pursuant to the features of the invention, the development apparatus includes a housing defining a chamber for storing a supply of particles therein. Means, disposed in the chamber of the housing, deposit particles on the latent image. Storing means store a plurality of differently colored particles remotely from the chamber of the housing. Means are provided for cleaning the particles from the chamber of the housing. Operator selectable means advance particles of a selected color from the storing means to the chamber in the housing.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
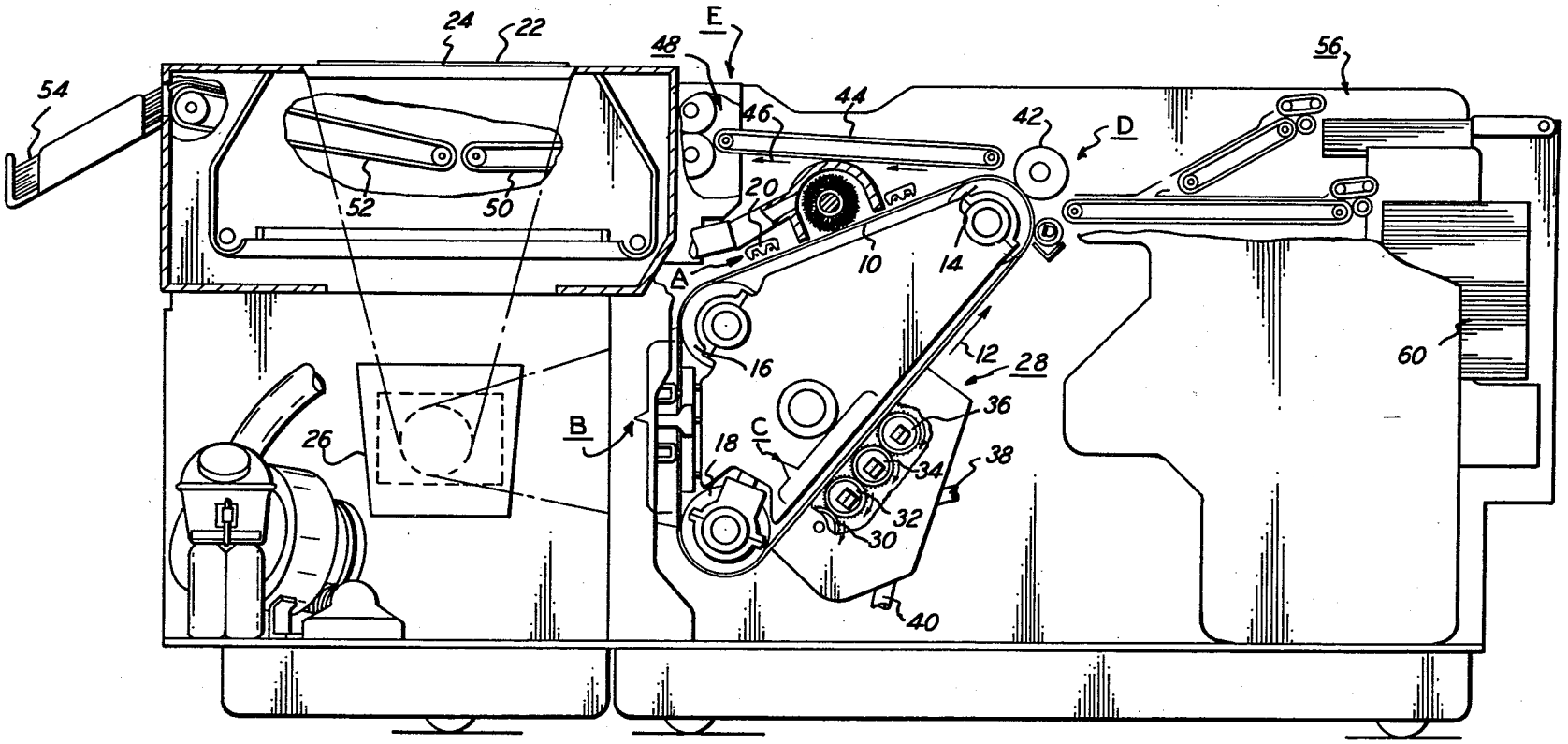
FIG. 1 is a schematic elevational view depicting an electrophotographic printing machine incorporating the features of the present invention therein.

For a general understanding of the illustrative electrophotographic printing machine, in which the features of the present invention may be incorporated, reference is had to the drawings. In the drawings, like reference numerals have been used throughout to designate identical elements. FIG. 1 schematically illustrates the various components of a printing machine incorporating the development system of the present invention. Although the development system is particularly well adapted for use in the FIG. 1 printing machine, it will become evident from the following discussion that it is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine are only shown schematically and their operation described briefly with reference thereto.

As illustrated in FIG. 1, the electrophotographic printing machine employs a belt 10 having a photoconductive surface. By way of example, belt 10 may be made from a selenium alloy deposited on a conductive substrate, such as aluminum. Belt 10 moves in the direction of arrow 12 to advance sequentially through the various processing stations disposed about the path thereof. Rollers 14, 16 and 18 support belt 10. A drive mechanism, i.e. a suitable motor, is coupled to roller 14 so as to advance belt 10 in the direction of arrow 12.

Initially, a portion of belt 10 passes through charging station A. At charging station A, a corona generating device, indicated generally by the reference numeral 20, charges the photoconductive surface of belt 10 to a relatively high substantially uniform potential. A suitable corona generating device is described in U.S. Pat. No. 2,836,725 issued to Vyverberg in 1958.

Thereafter, the charged portion of belt 10 rotates through exposure station B. At exposure station B, an original document 22 is placed upon transparent platen 24 face down. An illumination system flashes light rays upon original document 22 to produce image rays corresponding to the informational areas contained therein. The image rays are projected by means of an optical system 26 onto the charged portion of photoconductive belt 10. In this manner, the charged photoconductive surface of belt 10 is exposed to a light image of the original document. Exposure of the charged portion of the photoconductive surface to the light image discharges the charge thereon in accordance with the intensity of the light image projected thereto. In this way, an electrostatic latent image is recorded on the photoconductive surface of belt 10.

The electrostatic latent image recorded on belt 10 is advanced to development station C. At development station C, developer unit 28 has a plurality of magnetic brushes 30, 32, 34 and 36 disposed in housing 38 to move developer material adjacent to the electrostatic latent image recorded on belt 10. The developer mix comprises carrier granules having toner particles adhering thereto. Generally, the carrier granules are formed from a ferro-magnetic material while the toner particles are made from a heat settable plastic. In a typical magnetic brush system, a chain like array of developer mix extends in an outwardly direction from each magnetic brush to contact the electrostatic latent image recorded on the photoconductive surface. The latent image attracts electrostatically the toner particles from the carrier granules forming a toner powder image on belt 10.

Developer unit 28 is adapted to deposit toner particles of a pre-selected color onto the electrostatic latent image recorded on belt 10. Conduit 38 is one of a plurality of conduits for delivering operator selectable developer material of different colors from remote storage containers. Tube 40 is coupled to a vacuum blower system for removing developer material from developer unit 28 so as to enable differently colored developer material to be introduced therein via conduit 38. The detailed structure of developer unit 28 will be discussed hereinafter with reference to FIGS. 2 through 5, inclusive.

After development, the toner powder image is transported by belt 10 to transfer station D. Transfer station D is located at a point of tangency on belt 10 as it moves around roller 14. Transfer roller 42 is disposed at transfer station D with the copy sheet being interposed between transfer roller 42 and belt 10. Transfer roller 42 is electrically biased to a suitable magnitude and polarity so as to attract the toner powder image to the surface of the copy sheet in contact therewith. After transferring the toner powder image to the copy sheet, conveyer 44 advances the copy sheet in the direction of arrow 46 to fixing station E.

Fixing station E includes a fuser assembly indicated generally by the reference numeral 48. Fuser assembly 48 has a heated fuser roll engaging a backup roll. The surface of the copy sheet having the toner powder image thereon passes between the fuser roll and backup roll with the toner powder image contacting the fuser roll. In this manner, the toner powder image is permanently affixed to the copy sheet. After fusing, conveyers 50 and 52 advance the copy sheet to catch tray 54 for subsequent removal therefrom by the machine operator.

Referring now to the sheet feeding apparatus, sheet transport 56 advances, in seriatum, successive copy sheets from stack 58 or, in lieu thereof, stack 60. The machine programming permits the operator to select the desired stack from which the copy sheet will be advanced. In this way, the selected copy sheet is advanced to transfer station D where the toner powder image is transferred thereto.

It is believed that the foregoing description is sufficient for purpose of the present application to illustrate the general operation of an electrophotographic printing machine incorporating the features of the present invention therein. Referring now to the specific subject matter of the present invention, FIGS. 2 through 5, inclusive, depict the development apparatus employed in the FIG. 1 of the printing machine.

Figure 2:
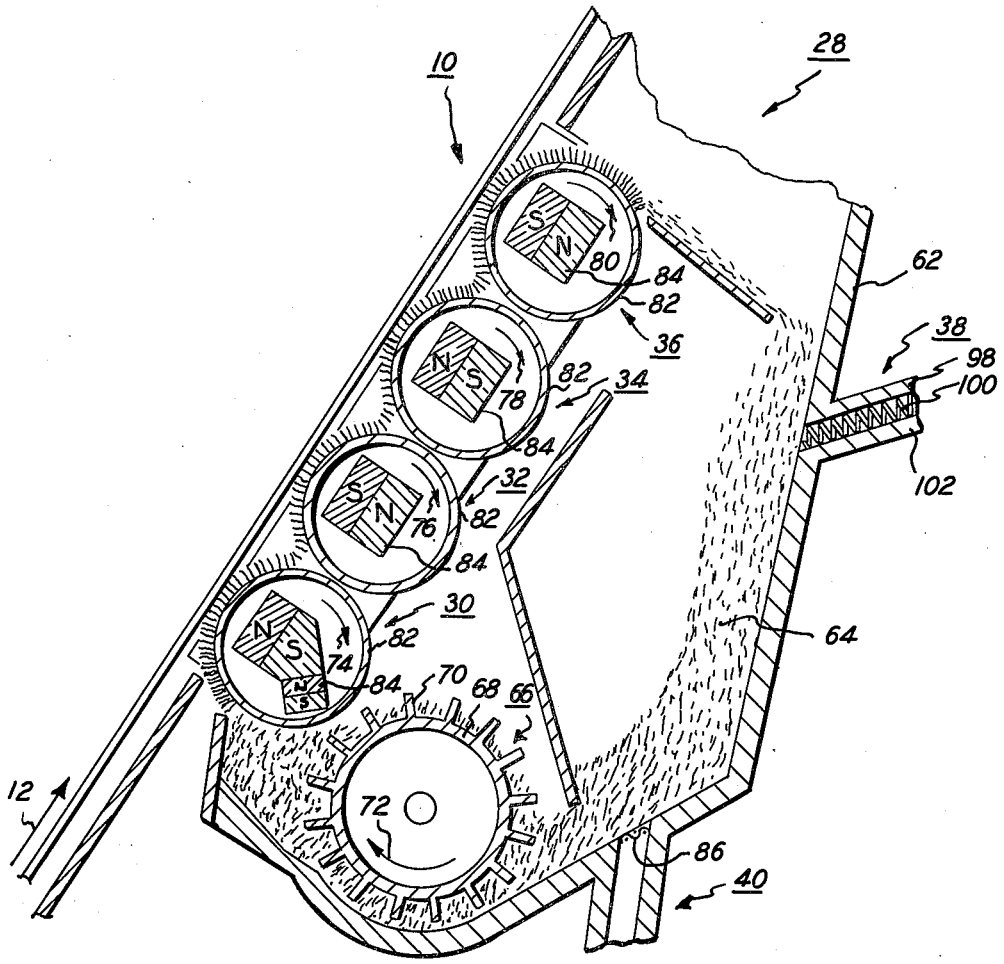
FIG. 2 is a fragmentary sectional elevational view illustrating the development apparatus employed in the FIG. 1 printing machine.

Turning now to FIG. 2, there is shown the detailed structure of developer unit 28. As shown therein, housing 62 has a chamber 64 for storing a supply of developer mix therein. Paddle wheel 66 includes a substantially tubular member 68 having vanes 70 extending outwardly in a radial direction therefrom. Paddle wheel 66 rotates in the direction of arrow 72 to advance the developer material to magnetic brush 30. Magnetic brushes 30, 32, 34 and 36 form a blanket of developer material moving in the direction of arrow 12 and positioned closely adjacent to the latent image recorded on belt 10. In this manner, the toner particles are attracted electrostatically from the carrier granules to the latent image in image configuration. Each of the developer rollers rotate in the direction of arrows 74, 76, 78 and 80, respectively. After the first original document has been reproduced in the first color, for example, black, the next successive original document may be reproduced in a second or different color on the same or another copy sheet. Changing developer material colors requires s cleaning the initial charge of developer material from chamber 64 of housing 62.

Mounted for rotation within chamber 64 of housing 62 are four magnetic brush developer rollers 30, 32, 34 and 36 positioned with their axis parallel with one another below belt 10. Each magnetic brush developer roller comprises an outer cylinder or tubular member 82 made of a non-magnetizable material and extending almost the length of housing 62. Tubular members 82 are mounted for rotation in housing 62. Disposed within each tubular member 82 is a bar magnet 84. The only distinction between each magnetic brush developer roller is the polarity of the bar magnet. Thus, magnetic brush developer roller 30 has the polarity of bar magnet 84 oriented in one direction, while magnetic brush developer roller 32 has the polarity of bar magnet 84 oriented in the opposite direction. Magnetic brush developer roller 34 has the polarity of bar magnet 84 oriented in the same direction as magnetic brush developer roller 30. Magnetic brush developer roller 36 has the polarity of bar magnet 84 oriented in the same direction as magnetic brush developer roller 32. As shown in FIG. 2, the peripheral walls of tubular members 82 are relatively close to each other. During a development cycle, tubular members 84 rotate in unision with the respective magnetic bars 84 being held substantially stationarily. The magnetic field emanating from bar magents 84 causes the developer mix to be attracted to the upper surface of tubular members 82. As tubular members 82 rotate in the direction of arrows 74, 76, 78 and 80, respectively, the developer mix advances across the upper surface of each tubular member 82. In this manner, the bristles of developer mix extend in an outwardly direction from housing 62 in contact with the electrostatic latent image recorded on belt 10. After passing magnetic brush developer roller 36, the remaining developer mix returns to chamber 64 of housing 62.

Figure 4:
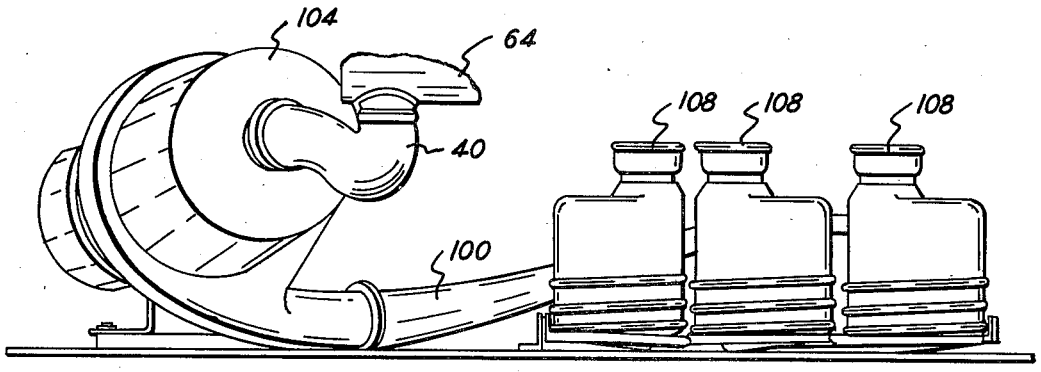
FIG. 4 is a schematic perspective view depicting the vacuum blower system for removing particles from the FIG. 2 development apparatus.
Figure 3:
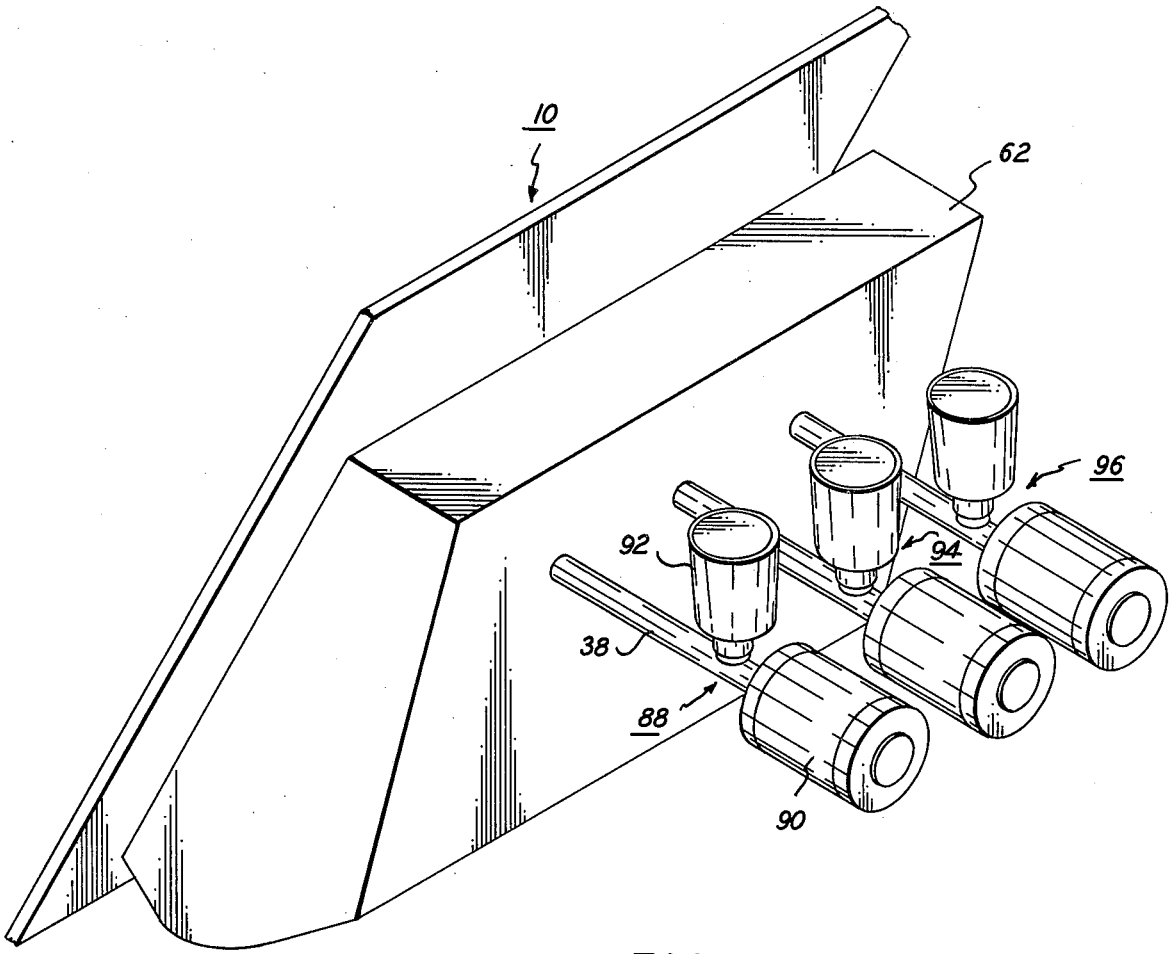
FIG. 3 is a schematic perspective view showing the remote containers storing the differently colored developer material associated with the FIG. 2 development apparatus.

In cleaning developer unit 28, the developer material is drained from chamber 64 of housing 62 through tube 40 by a vacuum blower system, such as is shown in FIG. 4. The vacuum blower system will be discussed hereinafter in greater detail with reference thereto. Screen 86 is disposed in the opening of tube 40 to prevent contaminants from passing with the developer material into the vacuum blower system. After the developer mix of the first color is drained from chamber 64 of housing 62, a new color developer mix is introduced therein. Conduit 38 is one of a plurality of conduits in communication with housing 62 for introducing developer material of a different color therein. Referring now to FIG. 3, the system for advancing differently colored developer mix into chamber 64 of housing 62 will be described. Advancing system 88 includes a conduit 38, motor 90 and storage container 92. Advancing systems 94 and 96 are substantially identical to advancing system 88 with the only distinction being the color of the developer mix contained within the storage container thereof. Hence, only advancing system 88 will be described hereinafter in detail. Conduit 38 couples storage container 92 to chamber 64 of housing 62. Conduit 38 is flexible and includes an outer tube 98 (FIG. 2) made preferably of Nylon, having a helical spring 100 mounted in bore 102 thereof. (FIG. 2). Helical spring 100 is connected to motor 90. Tube 98 has one aperture in communication with storage container 92 and another aperture in communication with chamber 64. In this way, developer mix from the storage container 92 descends into bore 102 and is advanced by helical spring 100 during the rotation thereof by motor 90. Hence, energization of motor 90 rotates helical spring 100 to advance developer mix from storage container 92 into chamber 64 of housing 62. Thus, the operator may select the desired color of developer material by energizing the appropriate motor associated with the corresponding developer material storage container. For example, energization of advancing system 82 could furnish blue developer material to chamber 64 of housing 62. However, energization of advancing system 94 could furnish red developer material, while energization of advancing system 96 could furnish green developer material thereto. Although three systems for advancing developer material of different colors to chamber 64 of housing 62 have been shown, one skilled in the art will appreciate that any number may be employed and only the size of the developer unit constrains the number of advancing systems associated therewith.

Referring now to FIG. 4, the system for removing the developer material from chamber 64 of housing 62 will be described hereinafter in greater detail. As shown, tube or duct 40 is coupled to housing 62. Motor driven blower or fan 104 coupled to duct 40 has an impeller mounted for rotation therein and is arranged to remove air and developer mix from chamber 64 of housing 62 through duct 40 and out again through duct 106 into containers 108. Activation of blower 104 removes the developer mix from chamber 64. The developer mix is sucked through the system and stored in containers 108. One container is associated with a corresponding color of developer material. This prevents intermixing of the different colored developer material enables the developer material to be reclaimed for subsequent reuse. After cleaning chamber 64 of housing 62, a new charge of developer mix, in a new color, may be introduced into chamber 64 for subsequent use in the printing machine to produce differently colored copies.

Figure 5:
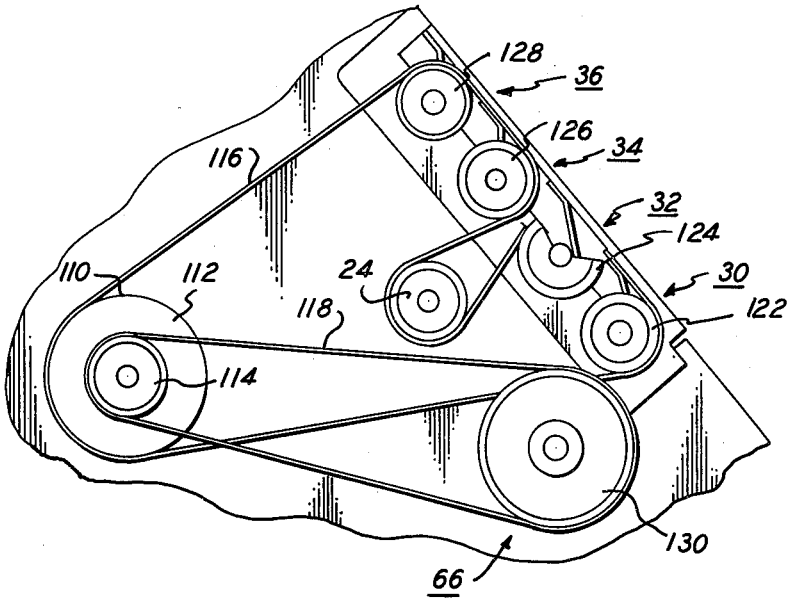
FIG. 5 is a fragmentary elevational view illustrating the drive system of the FIG. 2 development apparatus.

With continued reference to the drawings, FIG. 5 depicts the drive system associated with developer unit 28. The drive system includes a motor 110, a pulley 112 secured to the motor shaft, a smaller pulley 114 also secured to the motor shaft and timing belts 116, 118 for connecting pulleys 112 and 114, respectively, to the rotary components. Specifically, belt 116 is drivingly engagable with pulleys 120 and 122 mounted on the drive shafts of tubular members 76 of magnetic brushes 30 and 32, respectively. An idler pulley 124 and pulleys 126 and 128 secured to the drive shafts of tubular members 176 of magnetic brushes 34 and 36, respectively, are also in driving engagement with belt 116. Belt 118 connects drive pulley 114 with pulley 130 secured to the shaft of paddle wheel 66. This insures that paddle wheel 66 and tubular member 82 move in unision with one another. In this manner, tubular members 82 rotate in the direction of arrows 74, 76, 78 and 80, respectively. Similarly, paddle wheel 66 rotates in the direction of arrow 72.

In recapitulation, the development apparatus of the present invention includes a plurality of storage containers located remotely from the chamber of the developer housing. Each storage container has a supply of differently colored developer mix. Activation of a vacuum blower system removes the developer mix contained within the chamber of the developer housing. This permits an advancing system to move differently colored developer mixes into the chamber of the developer housing. In this manner, copies may be reproduced in different colors or have portions thereof color highlighted.

It is, therefore, evident that there has been provided in accordance with the present invention, an apparatus for developing an electrostatic latent image in any one of a plurality of different colors. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for developing a latent image arranged to be recorded on a member with particles, including:

a housing defining a chamber for storing a supply of particles therein;

means, disposed in the chamber of said housing, for depositing particles on the latent image;

means for storing a plurality of differently colored particles remotely from the chamber of said housing;

means for cleaning the particles from the chamber of said housing;

a plurality of conduits coupling said storing means with the chamber of said housing; and operator selectable means for advancing particles of a selected color from said storing means through one of said conduits to the chamber of said housing.

2. An apparatus as recited in claim 1, wherein said storing means includes a plurality of containers, each of said plurality of containers storing differently colored particles therein.

3. An apparatus for developing a latent image arranged to be recorded on a member with particles, including:

a housing defining a chamber for storing a supply of particles therein;

means, disposed in the chamber of said housing for depositing particles on the latent image;

a plurality of containers located remotely from the chamber of said housing, each of said plurality of containers storing differently colored particles therein;

a plurality of flexible conduits, each of said conduits coupling the chamber of said housing to one of said containers;

a plurality of elongated helical members, each of said plurality of helical members being positioned interiorly of each of said plurality of conduits;

operator selectable means for rotating each of said helical members independently to advance particles of a selected color from said container to the chamber of said housing; and means for cleaning the particles from the chamber of said housing.

4. An apparatus as recited in claim 3, wherein said cleaning means includes a vacuum blower coupled to the chamber of said housing to remove the particles therefrom.

5. An apparatus as recited in claim 4, wherein said depositing means includes:

a rotatably mounted non-magnetic tubular member; and magnetic means positioned interiorly of said tubular member for creating a magnetic field in the path of said tubular member.

6. An electrophotographic printing machine of the type having an electrostatic latent image recorded on a photoconductive member, wherein the improved development system includes:

a housing defining a chamber for storing a supply of developer material therein;

means, disposed in the chamber of said housing, for moving the developer material into contact with the electrostatic latent image recorded on said photoconductive member;

means for storing a plurality of differently colored developer materials remotely from the chamber of said housing;

means for cleaning the developer material from the chamber of said housing;

a plurality of conduits coupling said storing means with the chamber of said housing; and operator selectable means for advancing particles of a selected color from said storing means through one of said conduits to the chamber of said housing.

7. A printing machine as recited in claim 6, wherein said storing means includes a plurality of containers, each of said plurality of containers storing differently colored developer material therein.

8. An electrophotographic printing machine of the type having an electrostatic latent image recorded on a photoconductive member, wherein the improved development system includes:

a housing defining a chamber for storing a supply of developer material therein;

means, disposed in the chamber of said housing, for moving the developer material into contact with the electrostatic latent image recorded on said photoconductive member;

a plurality of containers located remotely from the chamber of said housing, each of said plurality of containers storing differently colored developer material therein;

a plurality of flexible conduits, each of said conduits coupling the chamber of said housing to one of said containers;

a plurality of elongated helical members, each of said plurality of helical members positioned interiorly of each of said plurality of conduits;

operator selectable means for rotating each of said helical members independently to advance developer material of a selected color from said container to the chamber of said housing; and means for cleaning the developer material from the chamber of said housing.

9. A printing machine as recited in claim 8, wherein said cleaning means includes a vacuum blower coupled to the chamber of said housing to remove the developer material therefrom.

10. A printing machine as recited in claim 9, wherein said moving means includes:

a rotatably mounted non-magnetic tubular member; and mangetic means positioned interiorly of said tubular member for creating a magnetic field in the path of said tubular member.

* * * * *